US005117718A

United States Patent [19]

Wittkopf

[11] Patent Number: 5,117,718

[45] Date of Patent: Jun. 2, 1992

[54] WEB PERFORATING APPARATUS

[75] Inventor: Eugene W. Wittkopf, Little Suamico, Wis.

[73] Assignee: Integrated Design Corporation, Green Bay, Wis.

[21] Appl. No.: 690,100

[22] Filed: Apr. 23, 1991

[51] Int. Cl.[5] ..... B26F 1/20

[52] U.S. Cl. ..... 83/342; 83/344; 83/349; 83/509; 83/672

[58] Field of Search ..... 83/342, 344, 672, 507, 83/508, 508.2, 341, 509, 349

[56] References Cited

U.S. PATENT DOCUMENTS 3,264,921 8/1966 Nystrand ..... 83/342
3,552,251 1/1971 Neff ..... 83/342 X
4,014,234 3/1977 Spengler .

*Primary Examiner*—Frank T. Yost
*Assistant Examiner*—Kenneth E. Peterson
*Attorney, Agent, or Firm*—Senniger, Powers, Leavitt & Roedel

[57] ABSTRACT

A rotary perforator having a rotary anvil roll carrying one or two anvils cooperable with a fixed perforating blade edge for forming lines of perforations at spaced intervals along a continous web fed between the anvil roll and the blade edge, with provision for feeding the web and driving the anvil roll at different speeds, and for positioning the anvil roll at different skew angles relative to a plane transverse to the path of the web at right angles to the edges of the web so that the lines of perforations extend at right angles to the edges of the web, and with provision for forming the perforations in each line progressively across the web.

6 Claims, 7 Drawing Sheets

WEB PERFORATING APPARATUS

BRIEF SUMMARY OF THE INVENTION

This invention relates to web perforating apparatus and more particularly to apparatus for forming lines of perforations at spaced intervals along a continuous web.

The invention is especially concerned with web perforating apparatus of a type in which a web to be perforated is fed forward between a rotary anvil roll and a fixed perforating blade means, the latter having a serrated edge against which the web is struck by an anvil on the anvil roll for forming the lines of perforations, with the perforations in each line formed progressively across the web, as distinguished from being all formed at once, thereby reducing the strain on the equipment. Reference may be made to U.S. Pat. No. 2,870,840 for a showing of a prior apparatus for effecting such progressive formation of perforations in lines across a web.

Among the several objects of this invention may be noted the provision of such apparatus which enables the web to be fed through the apparatus at velocities different from the velocity of the anvil on the anvil roll for forming the lines of perforations at different intervals along the length of the web and compensating for the difference in the web and anvil velocities for the formation of the lines of perforations perpendicular to the direction of the feed of the web, i.e. at right angles to the edges of the web; the provision of such apparatus adapted for formation of the lines of perforations at spaced intervals along the length of the web affording a wide selection of intervals over a wide range; and the provision of such apparatus of rugged construction and which, when set for forming the lines of perforations at a particular interval, accurately maintains the set interval.

In general, apparatus of this invention for forming lines of perforations extending transversely across a web at right angles to the edges of the web and spaced at regular intervals along the length of the web, comprises a main frame having opposite sides, an auxiliary frame having opposite sides, an anvil roll journalled in said opposite sides of the auxiliary frame for rotation on a generally horizontal axis, a blade carrier extending between and fixed to said opposite sides of the auxiliary frame, and perforating blade means carried by the blade carrier. The anvil roll has at least one anvil thereon extending lengthwise thereof, and means is provided for driving it at a predertermined speed. The perforating blade means carried by the carrier has a perforating edge engageable by the anvil as it rotates with the anvil roll in a cylindric path around the anvil roll axis, said perforating edge being disposed for forming the perforations progressively across the width of a web fed forward between the anvil roll and said edge. Means is provided for feeding a web in a predetermined path between the anvil roll and the perforating edge at a predetermined speed different from the speed of the anvil.

Means is provided for mounting the auxiliary frame on the main frame in a skewed position wherein the anvil roll axis is skewed relative to a transverse plane at right angles to the web path with the auxiliary frame adjustable to different skewed position, the arrangement being such that the web may be fed through the apparatus at different speeds and the skew of the anvil roll axis adjusted to form the lines of perforations extending transversely across the web at right angles to the edges of the web with the lines spaced at different intervals.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figures 2, 3:
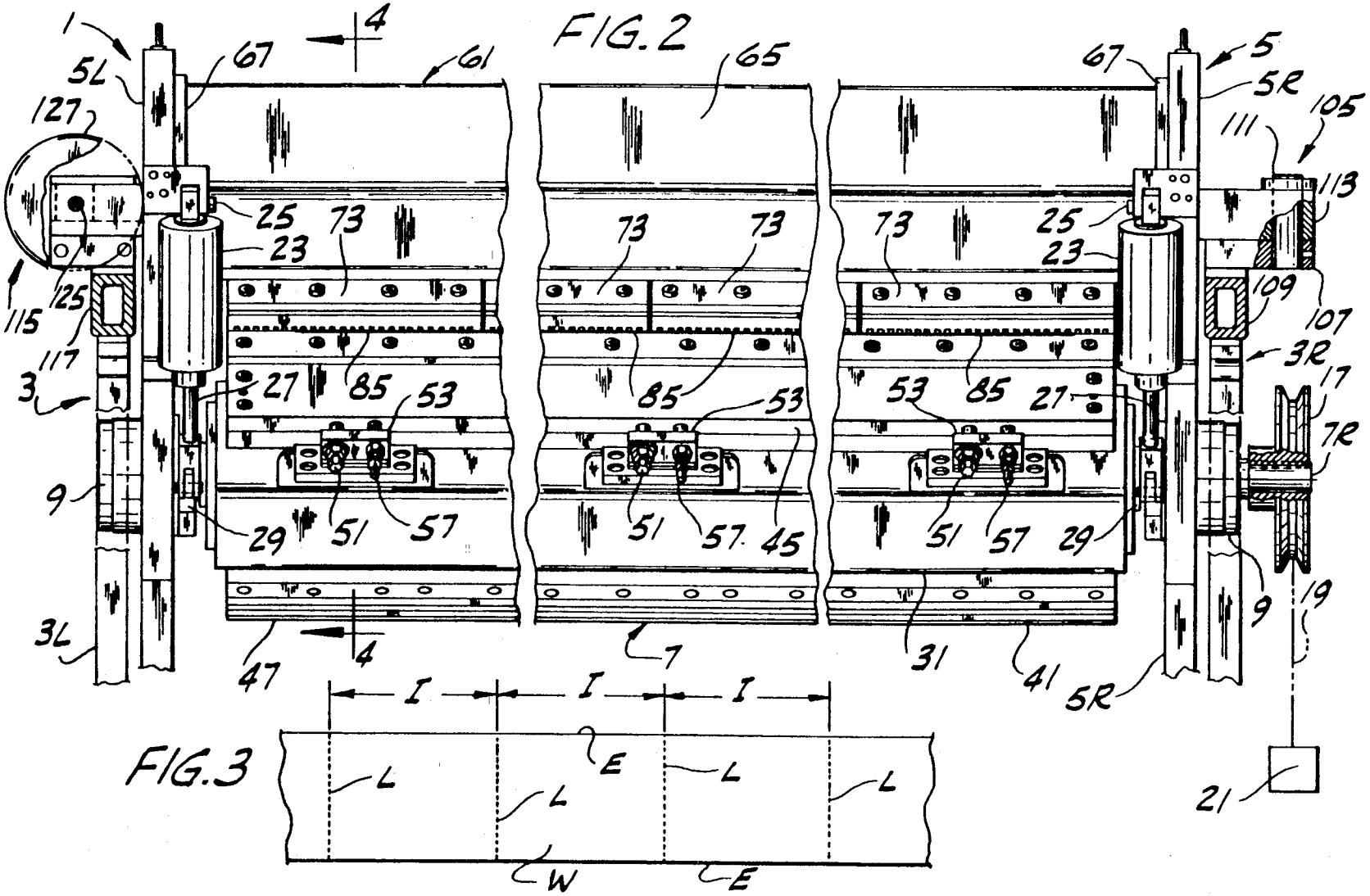
FIG. 2 is a view in elevation as viewed from the right of FIG. 1, broken away to reduce the width of the view, parts being shown in section.
FIG. 3 is a plan of a web with lines of perforations as produced by the apparatus.

Referring to the drawings, there is generally indicated at 1 apparatus of this invention for forming lines of perforations L (see FIG. 3) at right angles to a web W with the lines at right angles to the edges E of the web and spaced at regular intervals I along the length of the web. The web W may be, for example, a flattened continuous length of tubing of plastic film (e.g. polyethylene film) to be formed with or already having transverse seals (not shown) across its width at bag length intervals and to be formed with the lines of perforations L at bag length intervals each adjacent a seal for being wound into a roll of bags, each successive bag in the roll being adapted to be torn off for use. The web might be a single-ply web rather than a two-layer bag web, and may be of flexible sheet material other than plastic film (e.g. paper).

Figure 1:
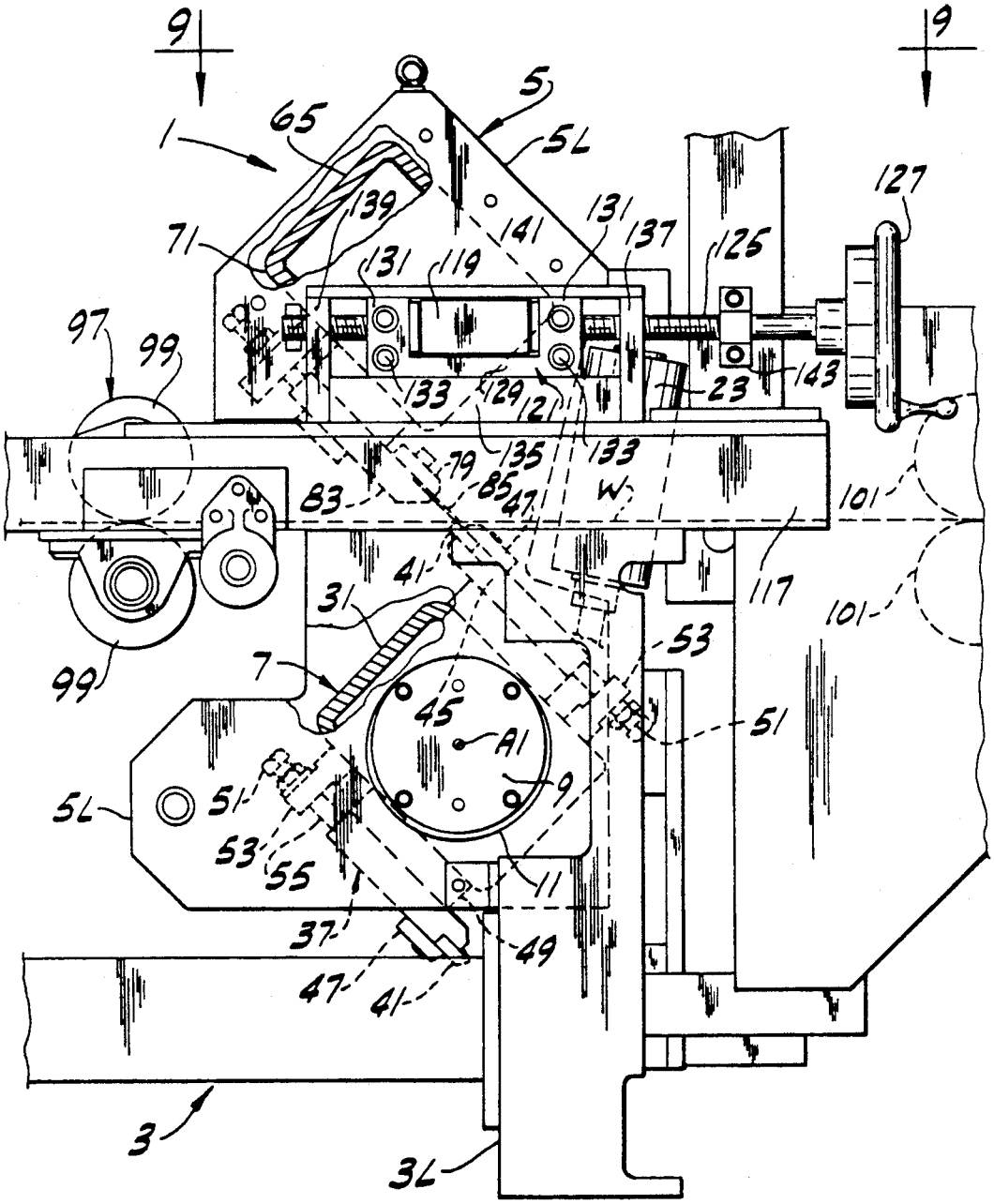
FIG. 1 is a side elevation of a web perforating apparatus of this invention, with parts broken away and parts shown in section.

The web perforating apparatus 1 generally comprises a main frame indicated in its entirety by the reference numeral 3 having opposite sides 3L and 3R (left and right) and an auxiliary frame generally indicated by the reference numeral 5 having opposite sides 5L and 5R (left and right) supported by the main frame. The apparatus may be originally provided with both the main and auxiliary frames already assembled, or the auxiliary frame may be provided per se for being retrofitted in an existing main frame. An anvil roll 7 is journalled for rotation in the opposite sides 5L, 5R of the auxiliary frame for rotation on a generally horizontal axis. Each of the sides 5L, 5R of the auxiliary frame is constituted by a rigid plate member, the anvil roll having trunnions 7L, 7R at its ends journalled in bearings 9 each rotatably mounted in a circular opening 11 in the respective plate 5L, 5R. Each bearing comprises a cylindrical bearing housing 13 rotatable on the axis of the respective opening 11 and an inner bearing race 15 in the housing. The trunnion 7R extends out of its bearing and carries a timing pulley 17 of a timing belt and pulley drive 19 driven by means indicated generally at 21 for driving the anvil roll at a predetermined speed, the anvil roll rotating in clockwise direction as viewed in FIG. 1

Figure 4:
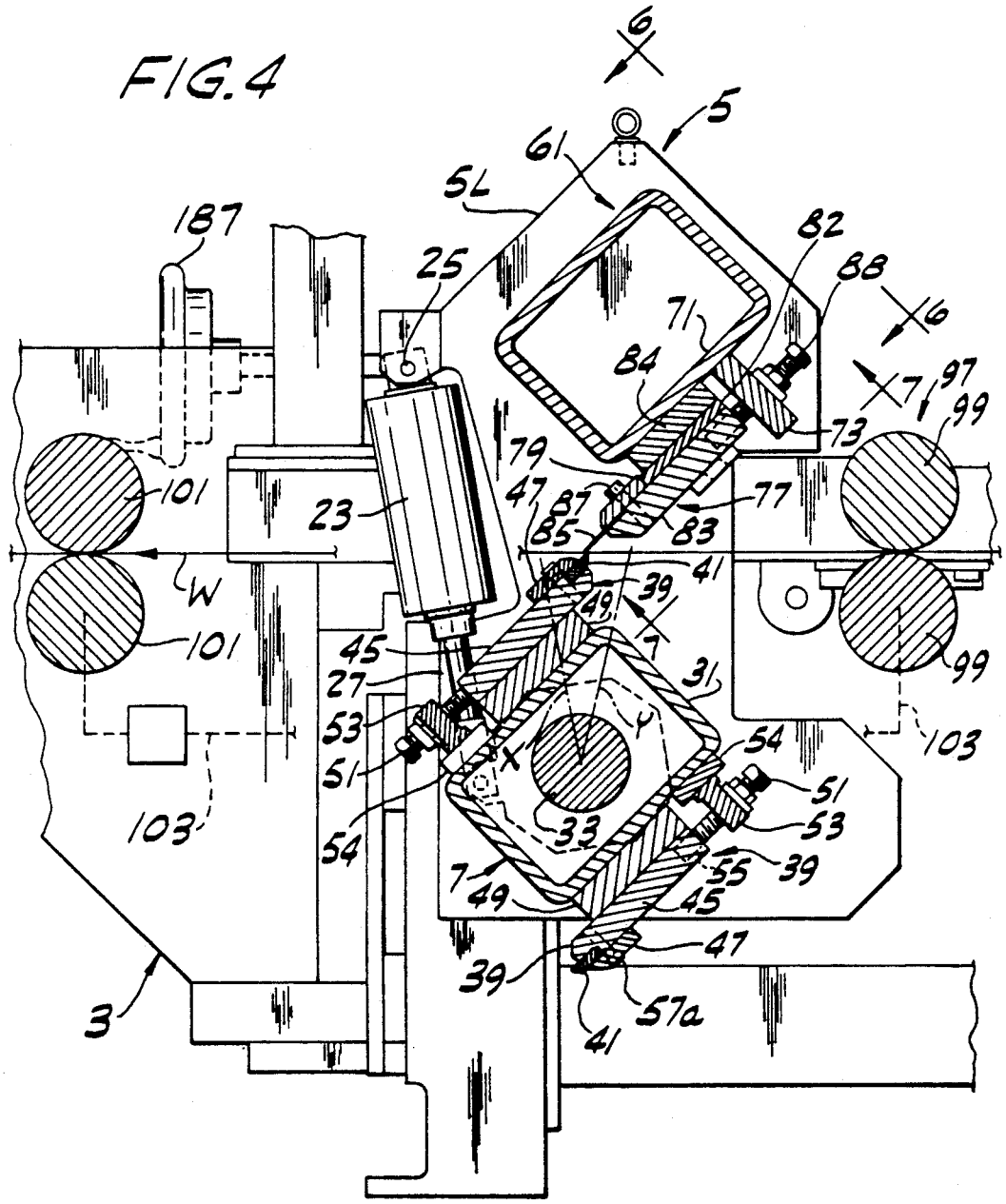
FIG. 4 is a vertical longitudinal section on line 4–4 of FIG. 2.
Figure 5:
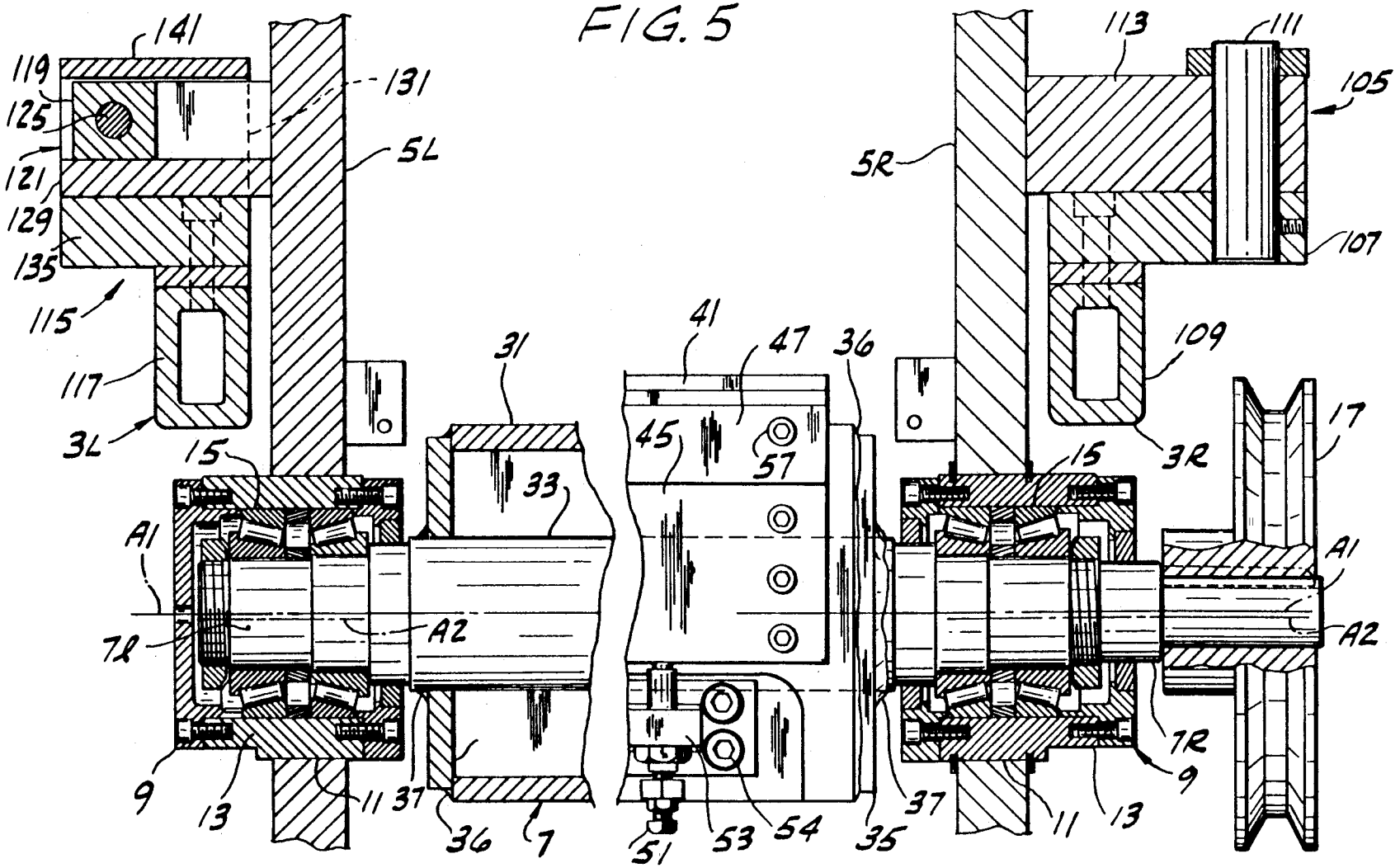
FIG. 5 is a view with parts shown in section of the opposite ends of an anvil roll of the apparatus.
Figure 6:
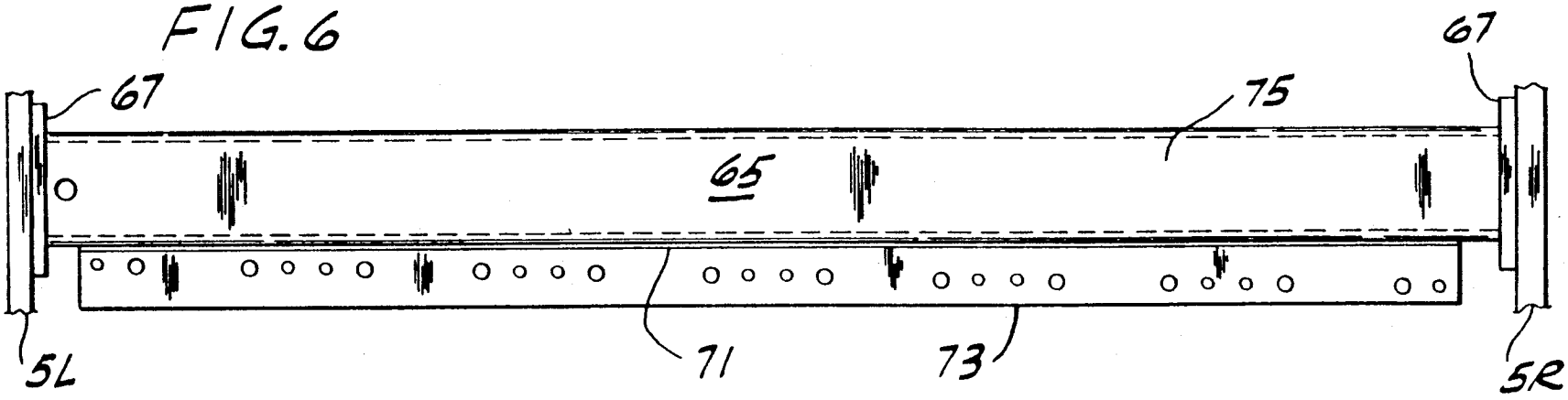
FIG. 6 is a view on line 6–6 of FIG. 4.

(counterclockwise as viewed in FIG. 4). The axis Al of each bearing housing 13 and the axis A2 of each race 15 are slightly offset (see FIG. 5) so that by rotating the bearing housings in their openings 11, the position of the anvil roll may be adjusted relative to a knife 85. This adjustment is effected by a pair of air cylinders 23, each pivoted at 25 on the inside of the respective side plate 5L, 5R and having its piston rod 27 coupled to the respective bearing housing as indicated at 29.

The anvil roll 7 comprises a body 31 consisting of a length of metal tubing of rectangular cross section, and a center shaft 33 extending through the tubular body and through end heads or caps 35 welded as indicated at 36 to the ends of the body, and to the shaft as indicated at 37. The ends of the shaft projecting out from the end caps constitute the trunnions 7L, 7R. The roll body 31, on each of the two opposite wider sides (the broad sides) thereof, carries means 37 for holding an anvil 41 thereon with the anvil extending lengthwise of the roll) body. The anvil 41 is constituted by an elongate metal strip extending from one end of the anvil roll to the other parallel to the anvil roll axis, this strip having a hardened insert 43 beveled as illustrated providing what may be called its working edge 43*a*. This edge travels in a cylindrical path P (see FIG. 4) around the axis of the anvil roll. The anvil roll axis is the axis of shaft 33, coincident with axis Al.

Each of the two anvils is held clamped in a pair of elongate clamp jaws 45 and 47 formed for clamping the respective anvil 41 flatwise therebetween. Jaw 45, which is the wider of these jaws, is adjustably slidable relative to the anvil roll body 31 in a plane parallel to the respective broad side of the body on a block 49 welded on that side of the body, adjustment being effected by adjustment screws 51 threaded in lugs 53 secured as indicated at 54 on the stated broad side of the body 31, the screws being threaded in tapped holes in the jaw 45 as indicated at 55. Each jaw 45 is backed by screws 57 threaded in the respective blocks 53. The anvil 41 is clamped between the jaw 47 and the jaw 45 by screws 57 extending through holes in the jaw 47 and threaded in tapped holes in the jaw 45. Set screws for holding the insert 43 are indicated at 60.

At 61 is indicated a perforating blade holder or carrier which comprises a body 65 consisting of a length of metal tubing of rectangular cross section extending between the side plates 5L, 5R above the anvil roll 7 and having welded-on end heads or caps 67 fastened to the side plates 5L, 5R. The rectangular cross-section body 65, which may also be referred to as a crossbeam, is oriented with one of its four sides, designated 71, inclined downward in forward direction with respect to travel of the web W through the apparatus, "forward direction" being from left to right as viewed in FIG. 1 and right to left as viewed in FIG. 4. Welded on this side 71 of the beam 65 extending lengthwise of the beam from near one end to the other is a back-up bar 73. The latter is skewed with respect to the apparatus extending along side 71 of the beam at an acute angle indicated at 73*a* to the plane of the adjacent sides 75 of the beam (see FIG. 7).

A plurality of perforating blade clamps each designated 77, six being shown, are positioned side by side on the face of the side 71 of the beam. Each of these six clamps comprises an inner jaw 79 and on outer jaw 83 adjustable relative to body 65. Jaw 83 slides an a pad 82 on the outside face of a block 84 welded on that side of the body. The outside face of pad 82 and the outside face of block 84 are slightly angled from end-to-end. A perforating blade 85 is held clamped between the jaws, screws 87 securing the jaws together. Each of the clamps 77 is adjustable for adjustment of the perforating blade 85 clamped therein by means of screws 89 threaded in bar 73 and threaded in a tapped hole in the jaw 83 as indicated at 91. Each jaw 83 is backed by differential screw 93 threaded in the bar 73 providing for fine adjustment.

Figure 7:
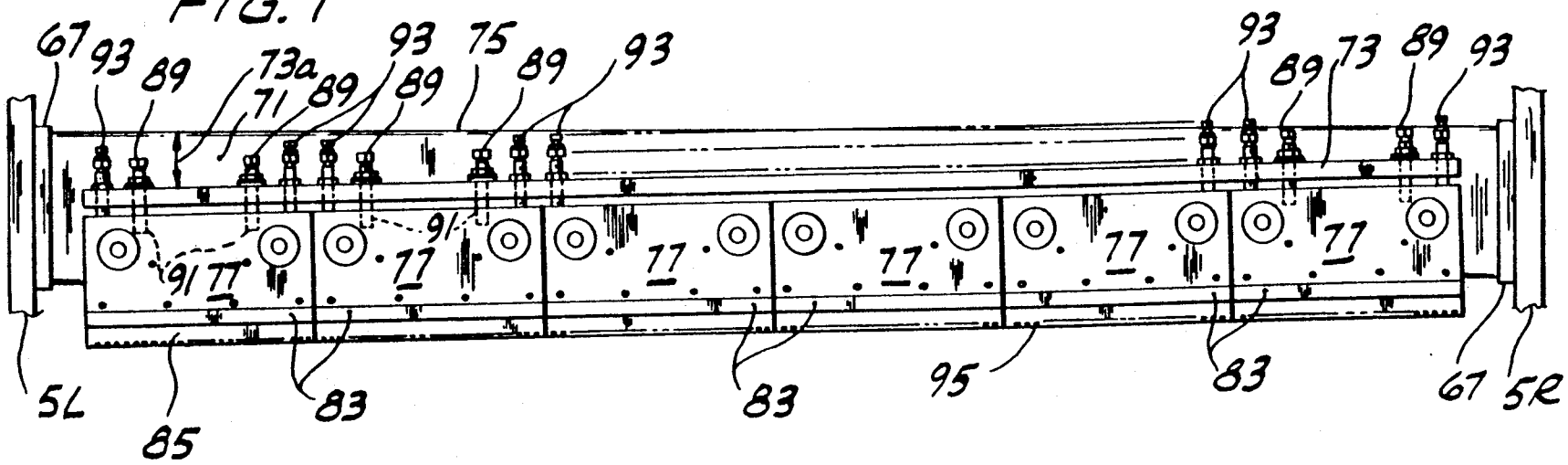
FIG. 7 is a view on line 7–7 of FIG. 4.
Figure 8:
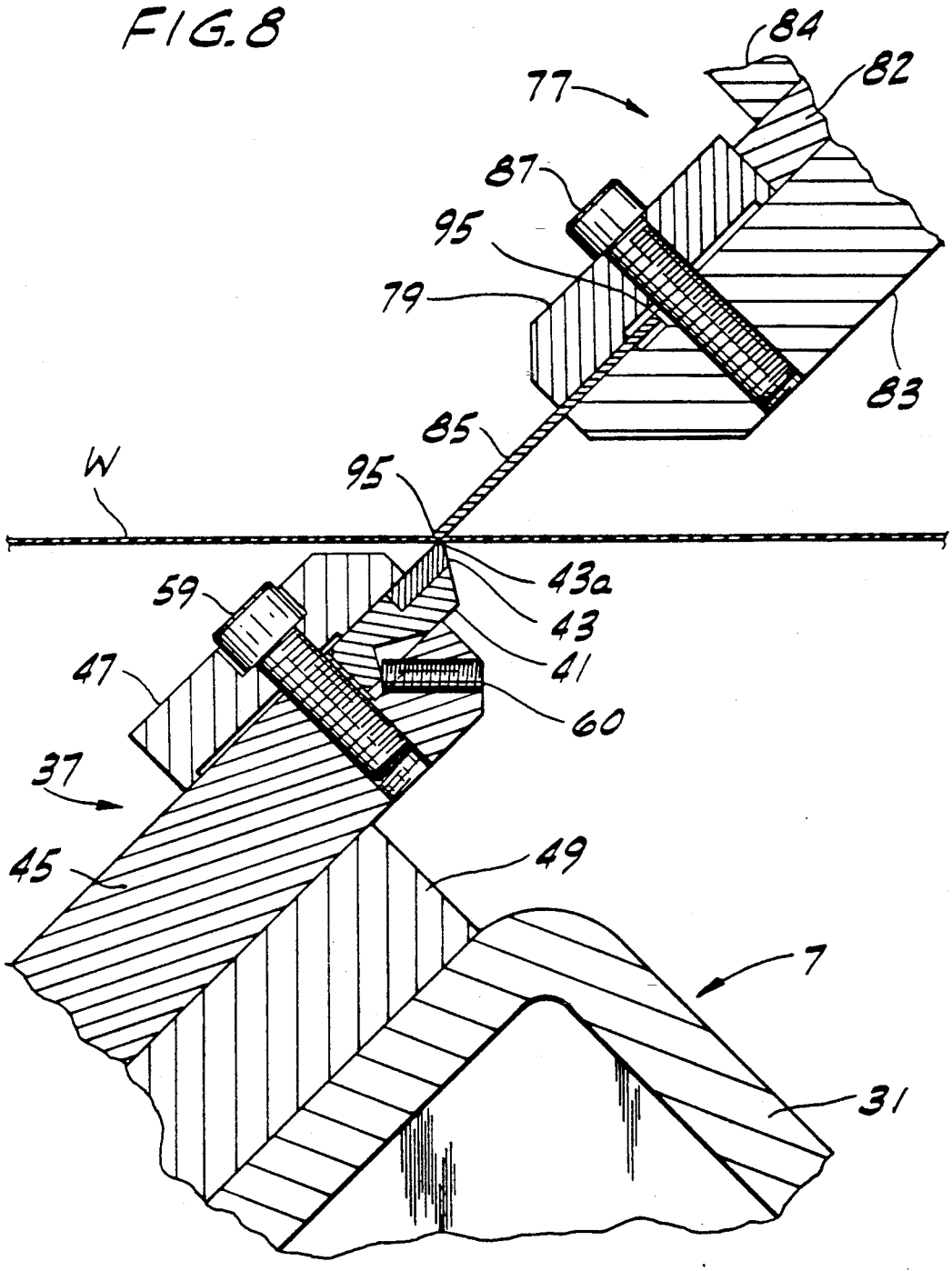
FIG. 8 is an enlarged fragment of FIG. 4 showing an anvil and perforating blade mean of the apparatus.
Figure 9:
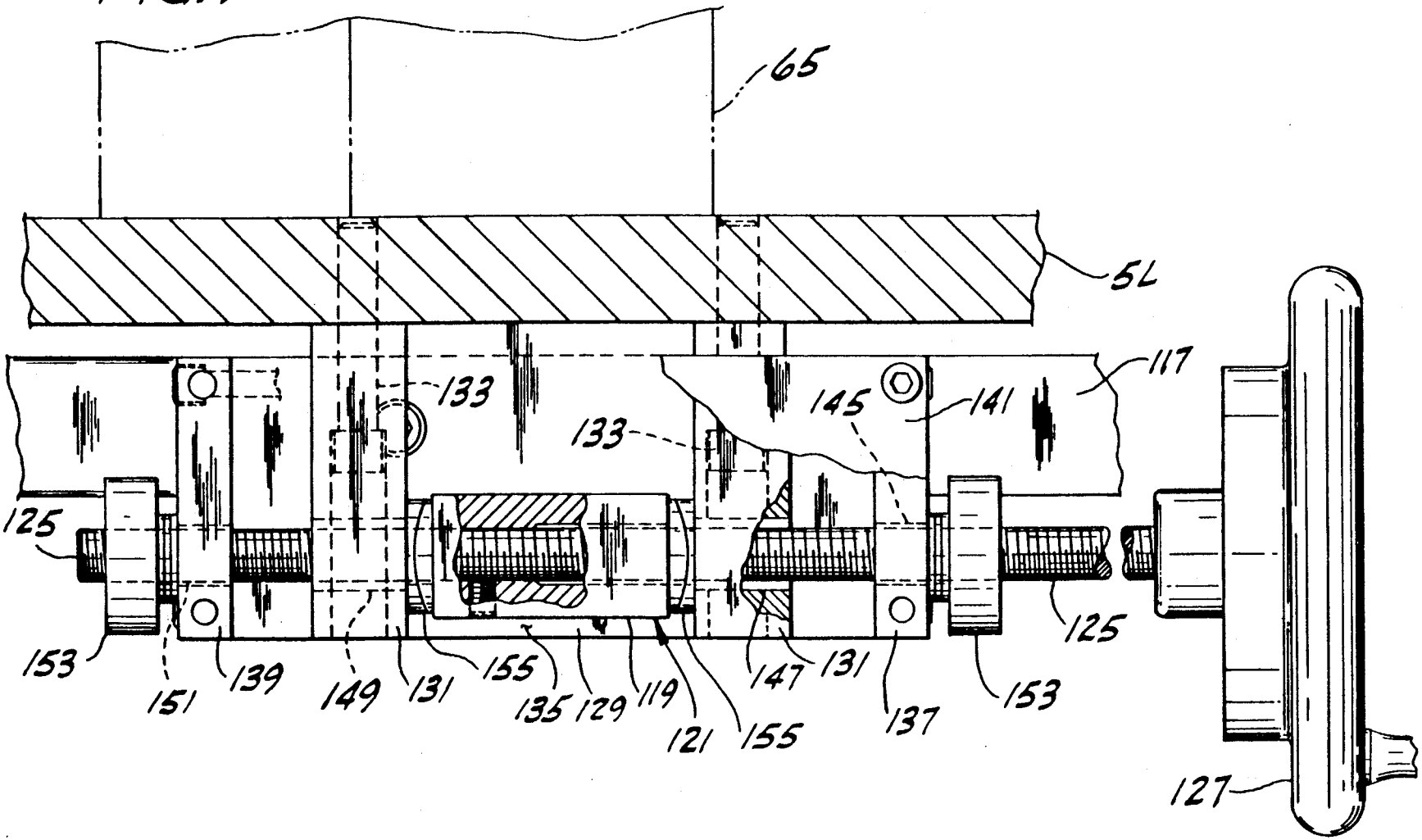
FIG. 9 is an enlarged view on line 9–9 of FIG. 1.

Each of the six perforating blades 85 is a generally rectangular blade with its two opposite longer edges serrated a indicated at 95 and with these edges slightly concave instead of straight. As held in the jaws the six blades are located in end-to-end relation with adjacent ends of the blades in contiguous relation as shown in FIG. 7, and with the outer serrated edges 95 of the blades extending as a generally continuous serrated blade edge generally in the form of a helix on the cylindrical path P of the edge 43*a* of each anvil of the anvil roll. With both long edges 95 of each blade serrated, the blades may be reversed when one edge wears. Lines X and Y in FIG. 4 indicate the skew of the anvil and blade edge.

At 97 is indicated means for feeding the web W forward between the anvil roll 7 and the perforating edge 95 of the perforating blades at a predetermined speed which may be different from the anvil roll speed. This means comprises a pair of web feed rolls such as indicated at 99 at the entrance side of the perforating apparatus 1 and a pair of web feed rolls such as indicated at 101 at the exit side of the perforating apparatus, these feed rolls being journalled in the main frame 3 and being driven by means such as indicated at 103. The feed rolls are located to feed the web forward in the pass plane defined by the cylindrical path of revolution P of the anvils and the helically disposed perforating blade edge 95, i.e. the generally horizontal path tangent to said cylindrical path P at the top thereof.

At 105 is generally indicated means for mounting the auxiliary frame 5 on the main frame 3 at one side thereof (the right side as viewed in FIG. 2) for pivotal adjustment about a generally vertical pivot axis. As shown, this means comprises a bracket 107 mounted on a rail 109 of the main frame 3 extending laterally outward therefrom above the anvil roll trunnion 7R and the pulley 17, a pivot pin 111 extending up from the bracket, and a lug 113 on the side plate 5R of the auxiliary frame 5 pivoted on the pin. Means indicated generally at 115 at the other side of the apparatus is mounted on a rail 117 of the main frame 3 and coupled to the other side of the auxiliary frame for adjusting the auxiliary frame 5 carrying the anvil roll 7, the blade carrier 61 and the set of blades 85 as a unit to different angular positions about the vertical axis of the pivot pin 111.

The adjusting means 115 comprises a nut 119 retained in a U-shaped body 121 secured on the outside of the left-hand side plate 5L of the auxiliary frame 5 and mounted for sliding movement in forward and rearward direction relative to the apparatus in a guide structure 123 mounted on the rail 117. The nut is threaded on a threaded shaft 125 having a handwheel 127 for turning it one way or the other for moving the nut and body 121 forward or rearward relative to the main frame 3 for swinging the left-hand end of the auxiliary frame forward or rearward for adjusting the angular position or skew of the anvil roll 7 and blade holder 65 relative to a line or plane at right angles to the path of travel of the web. (i.e. a line or plane perpendicular to the center line of the web). The U-shaped body has a bottom 129 and upwardly extending end flanges 131, being secured to the side plate 5L by screws 133 extending sidewise through the flanges 131. The guide structure 123 for the movable U-shaped body 121 comprises a base 135 mounted on the rail 117, end walls 137 and 139 extending out at the ends of the base, and a cover plate 141. The screw shaft 125 extends through a bearing at 143, through a hole 145 in end wall 137 of the guide 123, a hole 147 in the forward end flange 131 of the body 121, the nut 119, a hole 149 in the rearward end flange 139 of the body 121, and a hole 151 in the rearward end wall 139 of the guide 123, being held against axial movement by thrust bearings as indicated at 153. Part-spherical washers 155 are interposed between the ends of the nut 119 and flanges 131.

The apparatus 1 as above described is operable to form lines of perforations L at spaced intervals I over a wide range of intervals along a continuous web W with the lines at right angles to the edges E of the web by using one or two anvils 41, selecting the speed of the web, selecting the speed of the anvil roll, and adjusting the skew of the anvil roll as determined by the number of anvils used, and the web and anvil roll speeds. With regard to the skew of the anvil roll, it will be understood that this means the angle of the axis of the anvil roll with respect to a line perpendicular to the direction of travel of the web, i.e. with respect to a line at right angles to the web edges. The anvil roll is swingable about the vertical axis of the pin 111 to vary its skew from a plus on one side of such a line to a minus on the other side, the skew being zero when the anvil roll axis is in a vertical plane through a line at right angles to the web edges.

Considering a particular physical embodiment of the apparatus which has been built and operated, the anvil roll is of such length as to accommodate a web up to 72 inches wide, and is of such diameter as to have an effective circumference, i.e. the length of the cylindrical path traced by the edges of the anvils, of 45 inches. The auxiliary frame 5 carrying the anvil roll 7 and the perforating blade means 61, 85 is adjustable by the handwheel 127 at its left end (which is on what is called the operator's side of the apparatus), from a plus 0.902 inch position to a minus 0.902 inch position in infinite increments. The skew of the perforating blade edge 95 relative to a line extending transversely of the apparatus at right angles to the vertical plane of either web edge is 1,500 inches. That is, one end of the perforating blade edge is offset from the other end around on the circumference of the cylindrical path of either anvil 1.500 inches. With this 1.500 inch skew of the perforating blade edge relative to the anvil roll, the perforating or cutting time in degrees, i.e. the number of degrees of contact of the edge of either anvil with the perforating blade edge, is 12.022° divided by 360° or 3.34% of the time for one revolution of the anvil roll. With two anvils in use, the cutting time is 12.022° divided by 180° or 6.68% of the time for one revolution of the anvil roll.

One anvil 41 is used for spacing of the lines of perforations from 30.0 inches to 72.0 inches. For the 30.0 inch spacing there would be a slippage of 45.0 inches (the circumference of the cylindrical path of the anvil) minus 30.0 inches or plus 15.0 inches. For the 72.0 inch spacing there would be a slippage of 45.0 inches minus 72.0 inches or minus 27.0 inches. Without compensation, the lines of perforations with the minimum (30.0 inch) spacing would be biased 3.34% of 15.0 inches or 0.501 inches and with the maximum (72.0 inch) spacing would be biased 3.34% of −27.0 inches or 0.902 inch. Two anvils 41 are used for spacing of the lines of perforations from 9.0 inches to 30.0 inches. For the 9.0 inch spacing there would be a slippage of 22.5 inches (half the said circumference) minus 9.0 inches or plus 13.5 inches, and for the 30.0 inch spacing there would be a slippage of 22.5 inches minus 30.0 inches or minus 7.5 inches. Without compensation, the lines of perforations with the 9.0 inch spacing would be biased 6.68% of 13.5 inches or 0.902 inches and with the 30.0 inch spacing they would be biased 6.68% of 7.5 inches or −0.501 inch.

In proceeding to set up the apparatus for a given run, there is first selected the spacing in inches of the lines of perforations (i.e. from 9.0 inches to 72.0 inches). Then the production speed of the web is selected (e.g. in feet per minute). An example here would be 500 feet per minute. This selection may be determined by the speed of the web entering the apparatus from a preceding operation or the speed of the web leaving the apparatus for another operation. These two selectives determine the rate at which the lines of perforations are formed, e.g. 500 feet per minute × 12 inches (per foot divided by the selected spacing equals the number of lines of perforations cut per minute. For spacings from 9.0 to 30.0 inches, both anvils are used. For spacings from 30.0 to 72.0 inches one anvil is removed, a dummy anvil being applied for balancing the anvil roll. The line spacing (interval I) and the web speed determine the speed of the anvil roll 7. For example, for a 30 inch (2½ foot) interval and a web speed of 500 feet per minute, with one anvil the anvil roll spaced would be 500 divided by 2½ or 200 rpm. With one anvil on the anvil roll, the auxiliary frame 5 is adjusted by turning the handwheel to have the anvil roll skewed a distance equal to 3.34% of the circumference of the path P divided by one (one anvil), minus the interval I, and with two anvils on the anvil roll, the auxiliary frame is adjusted by turning the handwheel to have the anvil roll skewed a distance equal to 6.68% of the circumference of the path P minus the interval I. The skew distance referred to is the distance which the left end of the anvil roll is offset (plus or minus) from a line through the pin 111 perpendicular to the direction of travel of the web. With the anvil roll so adjusted for the predetermined speed of the web and speed of the anvil roll, the lines of perforations L are cut at right angles to the web edges E.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

What is claimed is:

1. Apparatus for forming lines of perforations extending transversely across a web having side edges with the lines of perforations at right angles to said edges of the web and spaced at regular selected intervals longitudinally of the web, said apparatus comprising:

a main frame having opposite sides;

an auxiliary frame having opposite sides;

an anvil roll journalled in said opposite sides of the auxiliary frame for rotation on a generally horizontal axis;

said anvil roll having two opposite flat sides extending parallel to one another and to the axis of the roll;

each of said flat sides having an anvil holding means adjustably slidable thereon in a plane generally parallel to said side toward and away from an edge of said flat side and projecting beyond said edge of said flat side;

two anvils each removably and replaceably held by a respective anvil holding means where it projects beyond the said edge of said flat side of the anvil roll, said anvils being spaced at 180° intervals around the anvil roll;

each anvil having a working edge which travels around in cylindrical path around the axis of the anvil roll;

means for driving the anvil roll at a predetermined speed;

a blade carrier extending between and fixed to said opposite sides of the auxiliary frame above the anvil roll;

said blade carrier having a flat side forming an acute angle with respect to an upstream end of the web, a bar fixed on said flat side of the blade carrier extending lengthwise of the blade carrier from adjacent one side of the auxiliary frame to adjacent one side of the auxiliary frame;

said bar being skewed with respect to a direction of travel of the web through the apparatus;

a plurality of perforating blade holders positioned side-by-side on said flat side of said blade carrier below said bar;

a plurality of perforating blades each held by a respective perforating blade holder;

each said perforating blade having a serrated perforating edge and said perforating blades being positioned in end-to-end relation along said flat side of the blade carrier to provide a continuous serrated perforating blade edge generally in the form of a helix on said cylindrical path of the working edge of the anvils;

each of said perforating blade holders being adjustable relative to the blade carrier on said flat side thereof for positioning said blades to provide said continuous edge;

means associated with said bar for adjusting each blade holder;

said serrated perforating edge being disposed for forming the perforations progressively across the width of a web fed forward between the anvil roll and said perforating edge;

means for feeding a web in a predetermined path between the anvil roll and the perforating edge at a predetermined speed different from a surface speed of the anvil; and means for mounting the auxiliary frame on the main frame in a skewed position wherein the anvil roll axis is skewed with respect to the direction of travel of the web, said auxiliary frame being adjustable to different skewed positions;

the apparatus being operable with one of the anvils in place and with different web speeds and with the auxiliary frame in different skewed positions for forming the lines of perforation extending transversely across the web at right angles to the edges of the web at different intervals in a first range of intervals, and operable with both anvils in place and with different web speeds and with the auxiliary frame in different skewed positions for forming the lines of perforations extending transversely across the web at right angles to the edges of the web at different intervals in a second range of intervals.

2. Apparatus as set forth in claim 1 wherein each of the anvil holding means comprises a pair of clamp members for clamping the respective anvil therebetween with the anvil extending lengthwise of the anvil roll, one of the clamp members of each pair being slidable on the respective flat side of the anvil roll and the other clamp member being on a side, opposite the anvil roll of said one clamp member, and further comprising means for releasably holding the clamp members together to clamp the anvil therebetween.

3. Apparatus as set forth in claim 1 wherein each perforating blade is of generally rectangular shape with its two longer edges serrated, each blade being mounted in its holder for reversal of the serrated edges.

4. Apparatus as set forth in claim 1 wherein the means for mounting the auxiliary frame on the main frame comprises means at one side of the main frame and the respective side of the auxiliary frame mounting the auxiliary frame for pivotal adjustment about a generally vertical axis; and means at the other side of the auxiliary frame mounted on the other side of the main frame and coupled to said other side of the auxiliary frame for adjusting the auxiliary frame with the anvil roll and the blade carrier as a unit to different angular positions about said generally vertical axis.

5. Apparatus as set forth in claim 1 wherein each anvil is adjustable on the anvil roll for web perforating engagement with the perforating blade edge.

6. Apparatus as set forth in claim 5 wherein the anvil roll is journalled in bearings in the auxiliary frame with the bearings adjustable for adjustment of the anvil roll axis toward and away from the perforating blade edge.

* * * * *